US006392225B1

(12) United States Patent
Schwartz et al.

(10) Patent No.: US 6,392,225 B1
(45) Date of Patent: May 21, 2002

(54) METHOD AND APPARATUS FOR TRANSFERRING IONS FROM AN ATMOSPHERIC PRESSURE ION SOURCE INTO AN ION TRAP MASS SPECTROMETER

(75) Inventors: Jae C. Schwartz, San Jose, CA (US); John Edward Philip Syka, Charlottesville, VA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 09/160,639

(22) Filed: Sep. 24, 1998

(51) Int. Cl.[7] ..... H01J 49/42

(52) U.S. Cl. ..... 250/292; 250/396; 250/282; 250/299

(58) Field of Search ..... 250/396, 282, 250/299, 292

(56) References Cited

U.S. PATENT DOCUMENTS 3,800,140 A * 3/1974 Brubaker ..... 250/299
4,540,884 A 9/1985 Stafford et al. ..... 250/282
4,736,101 A 4/1988 Syka et al. ..... 250/292
5,171,990 A 12/1992 Mylchreest et al. ..... 250/288
5,420,425 A 5/1995 Bier et al. ..... 250/292
5,468,957 A * 11/1995 Franzen ..... 250/282
5,572,035 A * 11/1996 Franzen ..... 250/396
5,750,993 A 5/1998 Bier ..... 250/282

* cited by examiner

*Primary Examiner*—Jack Berman
*Assistant Examiner*—Anthony Quash
(74) *Attorney, Agent, or Firm*—Flehr Hohbach Test Albritton & Herbert LLP

(57) ABSTRACT

An ion transfer assembly for transferring ions from an atmospheric pressure ion source into an ion trap mass spectrometer with reduced random noise during analysis of the transferred ions. A method of reducing noise due to charged particles, undesolvated charged droplets, or ions in an ion trap mass spectrometer connected to an atmospheric pressure ionization source.

8 Claims, 6 Drawing Sheets

METHOD AND APPARATUS FOR TRANSFERRING IONS FROM AN ATMOSPHERIC PRESSURE ION SOURCE INTO AN ION TRAP MASS SPECTROMETER

BRIEF DESCRIPTION OF THE INVENTION

An ion transfer assembly for directing ions from an atmospheric pressure ion source into an ion trap mass spectrometer with reduced random noise during the analysis of the transferred ions by the ion trap mass spectrometer.

BACKGROUND OF THE INVENTION

Atmospheric pressure ion sources coupled to mass spectrometers by an ion transfer assembly often produce random noise spikes which can severely limit the signal-to-noise ratio in the mass spectra. These noise spikes are believed to be caused by charged particles or clusters ions which reach the detector region at random times. The abundance of the noise can be affected by several parameters related to the ion source including spray stability, involatile buffer concentration, solvent flow, and sampling configuration. This noise has been shown in U.S. Pat. No. 5,171,990 to be reduced in an ion transfer assembly by moving the capillary off-axis from the skimming electrode at a small cost in sensitivity but with a large increase in signal-to-noise ratio.

Ion trap mass spectrometers such as described in U.S. Pat. Nos. 4,540,884 and 4,736,101, and the various forms described in U.S. Pat. No. 5,420,425 have the advantage that the injection of ions from the ion source occurs at a different time than when the mass spectrum is taken and therefore allows rejection of the charged particles and ions during mass analysis. This allows the appropriate electric field for this rejection to be used during the time a mass analysis is being carried out. One approach that has been used is described in U.S. Pat. No. 5,750,993 and involves simply putting a lens (one which resides at lower pressures) to a high repelling potential at the appropriate time to block charged particles and ions from entering the ion trap mass spectrometer during mass analysis. However, large voltages (>300V) are necessary for this method and high energy noise particles still may penetrate the blocking potential. The invention described here utilizes a transverse dipole field along the entire length of a RF multi-pole ion guide to deflect the noise particles and prevent them from entering the ion trap. This method requires less voltage and is more effective in stopping the noise particles and ions from entering the ion trap during mass analysis.

OBJECTS AND SUMMARY OF THE INVENTION

It is an object of the present invention to provide an ion transfer assembly for directing ions from an atmospheric pressure ionization source of an ion trap mass spectrometer with reduced random noise and to a method of operation of the ion transfer assembly.

It is another object of the present invention to provide an ion transfer assembly employing multi-rod ion guides and means for applying appropriate RF and DC voltages to the rods which allows efficient transmission of ions to an ion trap while being able to reject random noise during mass analysis.

The foregoing and other objects of the invention are achieved by an ion transfer assembly which includes multi-rod ion guides for transferring ions from an atmospheric pressure ion source to an ion trap mass spectrometer, including means for applying RF and DC voltages to said rods to transfer ions into the ion trap for analysis by the mass spectrometer, and means for applying a DC voltage to said rods to create a dipolar field transverse to the ion path axis (with or without RF voltages), while the ions are analyzed by the mass spectrometer to minimize noise introduced by charged particles, desolvated charged droplets and ions from the atmospheric pressure ionization source by deflecting the particles and ions.

BRIEF DESCRIPTION OF THE DRAWINGS

The foregoing and other objects of the invention will be more clearly understood from the description to follow when read in conjunction with the accompanying drawings of which.

DESCRIPTION OF PREFERRED EMBODIMENT

Figure 1:
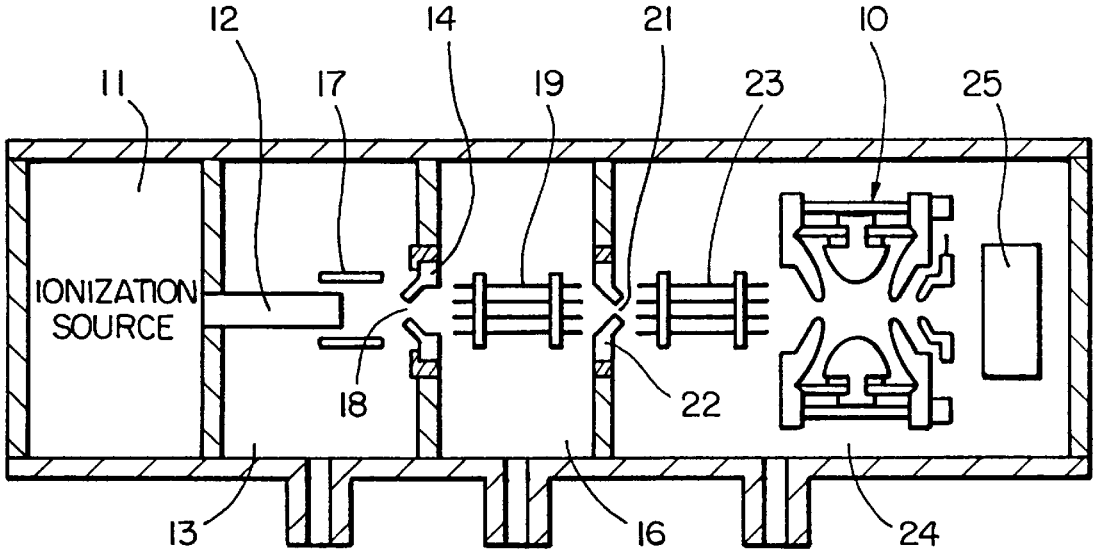
FIG. 1 is a schematic diagram of an atmospheric pressure ionization source coupled to an ion trap mass spectrometer by an ion transfer assembly.

Referring to FIG. 1, an atmospheric pressure ionization source 11 such as an electrospray ionization source or an atmospheric pressure chemical ionization source is connected to receive a liquid sample from an associated apparatus such as a liquid chromatograph or syringe pump and which supplies a source of ions to an ion trap mass spectrometer 10. The source 11 forms ions representative of the effluent from the liquid chromatograph. The ions are transferred from the ion source to the mass spectrometer by an ion transfer assembly. Particularly, the ions are transported from the ion source through a capillary 12 into a first chamber 13 which is maintained at a lower pressure (~1 TORR) than the atmospheric pressure of the ionization source 11. Due to the differences in pressure, ions and gases are caused to flow through the capillary 12 into the chamber 13. The end of the capillary is opposite skimmer 14 which separates the lower pressure region 13 from a still lower pressure second region 16. In the ion transfer assembly shown, a tube lens 17 surrounds the end of the capillary and provides an electrostatic field which focuses the ion beam leaving the capillary so that the ions flow through the skimmer aperture 18. The operation of the tube lens is described in U.S. Pat. No. 5,157,260 which is incorporated herein by reference. During ion transmission, a multi-rod ion guide such as octopole 19 has RF applied between adjacent rods and the appropriate DC offset applied to all rods and acts to draw out, guide and focus ions from the skimmer 14 through the second region and through aperture 21 within the interoctopole lens 22. Ions traveling through the aperture 21 are directed by a second RF operated multi-rod ion guide such as octopole 23 into the ion trap mass spectrometer 10 disposed in evacuated chamber 24. During a mass analysis, the ions are ejected from the ion trap mass spectrometer 10 and are detected by detector 25 whose output can be displayed as a mass spectrum.

The present invention applies a DC potential difference between rods on opposite sides of the center line of the multi-rod ion guides 19 or 23 when the ion trap mass spectrometer is analyzing the ions previously introduced into the ion trap. The DC voltage produces a transverse dipole field along the length of the multi-rod ion guide which causes any charged ions or particles which travel into the guide to be deflected away from the axis and be lost on the rods or the envelope which houses the ion guide. The dipole field prevents the charged ions, particles or desolvated droplets from entering the ion trap or the detector region beyond where they would generate noise spikes in the mass spectrum obtained by the mass spectrometer. Ideally, the strongest dipole field possible should be used and would be achieved by switching the opposite sets of rods to the maximum power supply voltages available of opposite polarity. The RF voltage applied to the multi-rod ion guide can either be left on or turned off which can help noise and ion rejection.

The ability to apply the dipole field across opposite sets of rods of the multi-rod ion guide while keeping the flexibility of having the RF voltage on or off and also minimizing the number of switches used, requires additional secondary windings on the transformer coil which drives the radio frequency (RF) voltages applied to the multi-rod ion guide.

Figure 2:
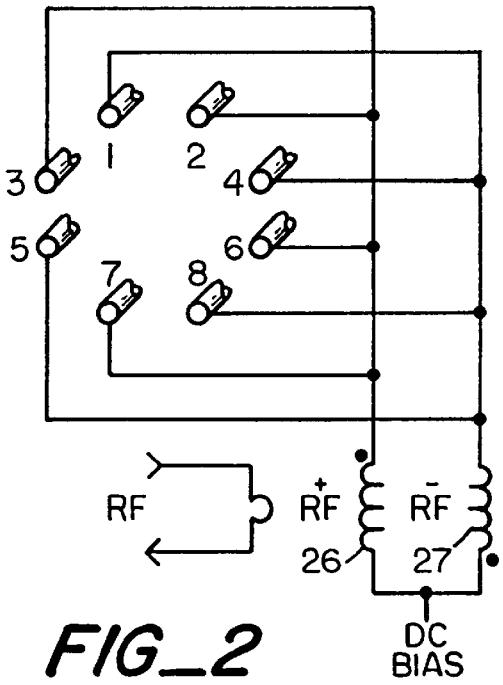
FIG. 2 shows eight parallel rods forming an octopole ion guide with RF and DC voltage connections for standard traditional transmission-only operation.

FIG. 2 shows the configuration for standard operation of an octopole ion guide with appropriate RF voltage connections and a DC bias applied to all rods. Rods on one side of the center line are numbered evenly 2,4,6,8, and rods on the opposite side of the center line are numbered 1,3,5,7. As in the standard operation of all multi-rod RF only transmission devices, the rods are connected to an RF voltage source where rods 1,5,4,8 connected to secondary transformer winding 26 are at the same phase RF voltage. Rods 3,7,2,6 connected to the secondary transformer winding 27 all have the same RF voltage but which is 180 degrees out of phase with that applied to rods 1,5,4,8. Thus, alternate rods have RF voltages of different polarity. This RF voltage causes ions to be efficiently transmitted through the device. This RF voltage has a reference or center potential which may or may not be ground. For positive ions there is typically a small negative DC bias, e.g. −3 volts, applied to all the rods in order to accelerate ions into the device.

Figure 3:
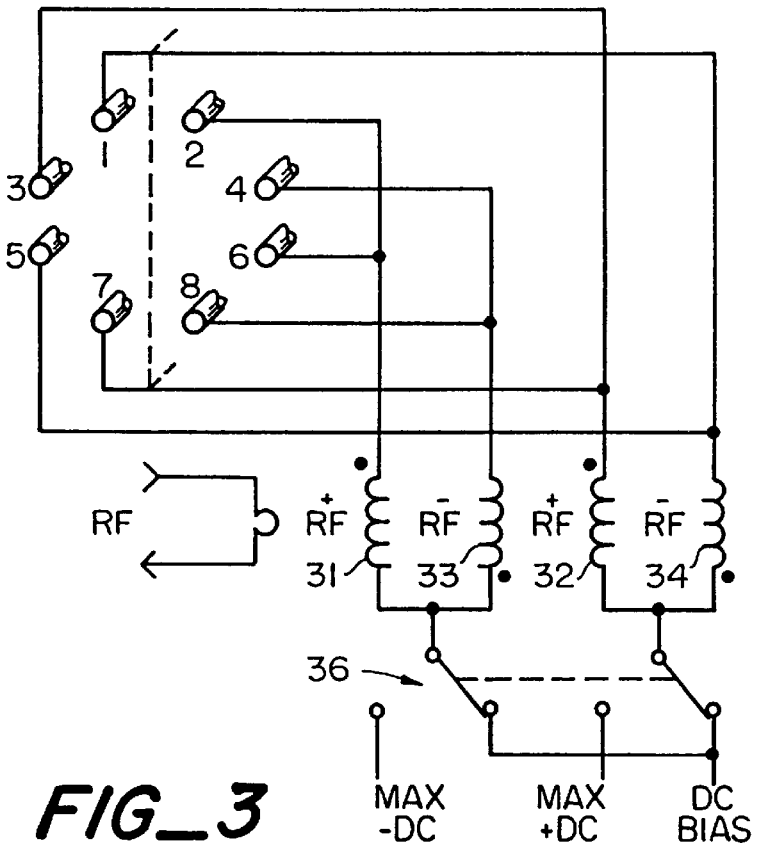
FIG. 3 shows eight parallel rods forming an octopole ion guide used in the ion transfer assembly with RF and DC voltage connections and switch for implementation of the present invention.

FIG. 3 shows the configuration for operation of an octopole ion guide and the respective connections to RF and DC voltage sources for the preferred implementation of the present invention. With the switch 31 in the right side position, the multi-rod ion guide works in the standard ion transmission mode in order to transmit ions to the ion trap as in FIG. 2 with RF voltages of different polarities applied to the rods 2,3,6,7, and 1,4,5,8 via the secondary transformer windings 31,32 and 33,34, respectively. However, during mass analysis of those ions, the switch 34 is set to the left side position applying voltages −DC, +DC to generate a transverse dipole field between opposite rods along the length of the device, that is, between the rods 2,4,6,8 and the rods 1,3,5,7. The dipole field blocks noise particles and ions from being transmitted from the ion source to the ion trap mass spectrometer.

Figure 4:
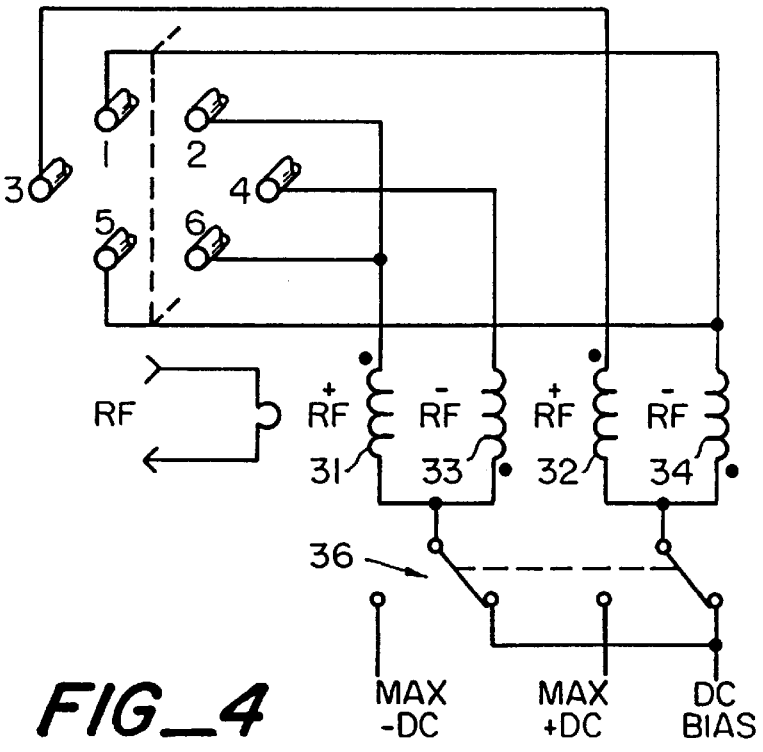
FIG. 4 shows six parallel rods forming a hexapole ion guide used in the ion transfer assembly with RF and DC voltage connections and switch for implementation of the present invention.
Figure 5:
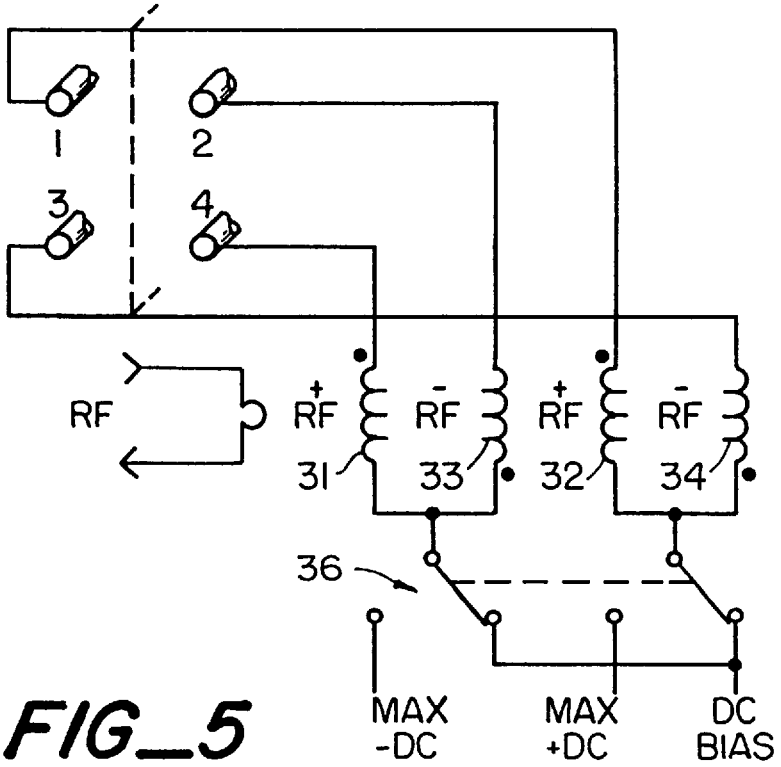
FIG. 5 shows four parallel rods forming a quadrupole ion guide used in the ion transfer assembly with RF and DC voltage connections and switch implementation of the present invention.
Figure 6:
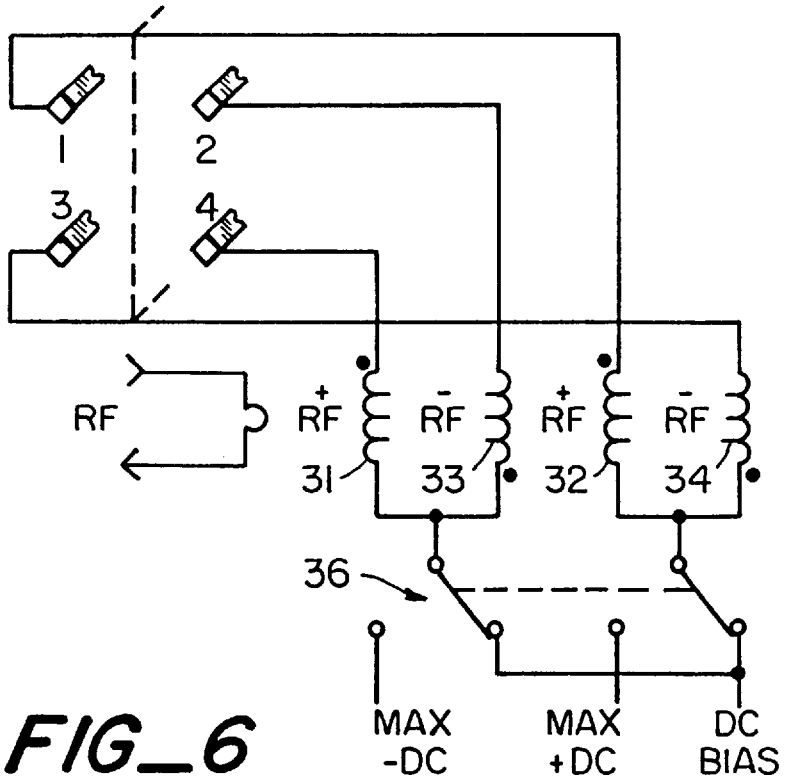
FIG. 6 shows four parallel square rods forming a square quadrupole ion guide used in the ion transfer assembly with RF and DC voltage connections and switch implementation of the present invention.

FIGS. 4–6 show different multi-rod numbers and types of ion guides with the appropriate connections to RF and DC voltage sources to transmit or block the transmission of ions according to the present invention. FIGS. 4 and 5 show hexapole and quadrupole rod arrangements, respectively, while FIG. 6 illustrates a quadrupole rod assembly using square rods. Otherwise operation is as described above.

Referring to FIG. 4, RF fields of opposite polarity are applied to the rods 1,4,5, and 2,3,6 via secondary windings 31,32 and 33,34, respectively. The −DC and +DC voltages are applied to the rods 1,3,5 and 2,4,6 respectively. In FIGS. 5 and 6 the RF fields of opposite polarity are applied to rods 1,4 and 2,3 via secondary windings 31,32 and 33,34, respectively. The −DC and +DC voltages are applied to rods 1,3 and 2,4, respectively.

Figure 7:
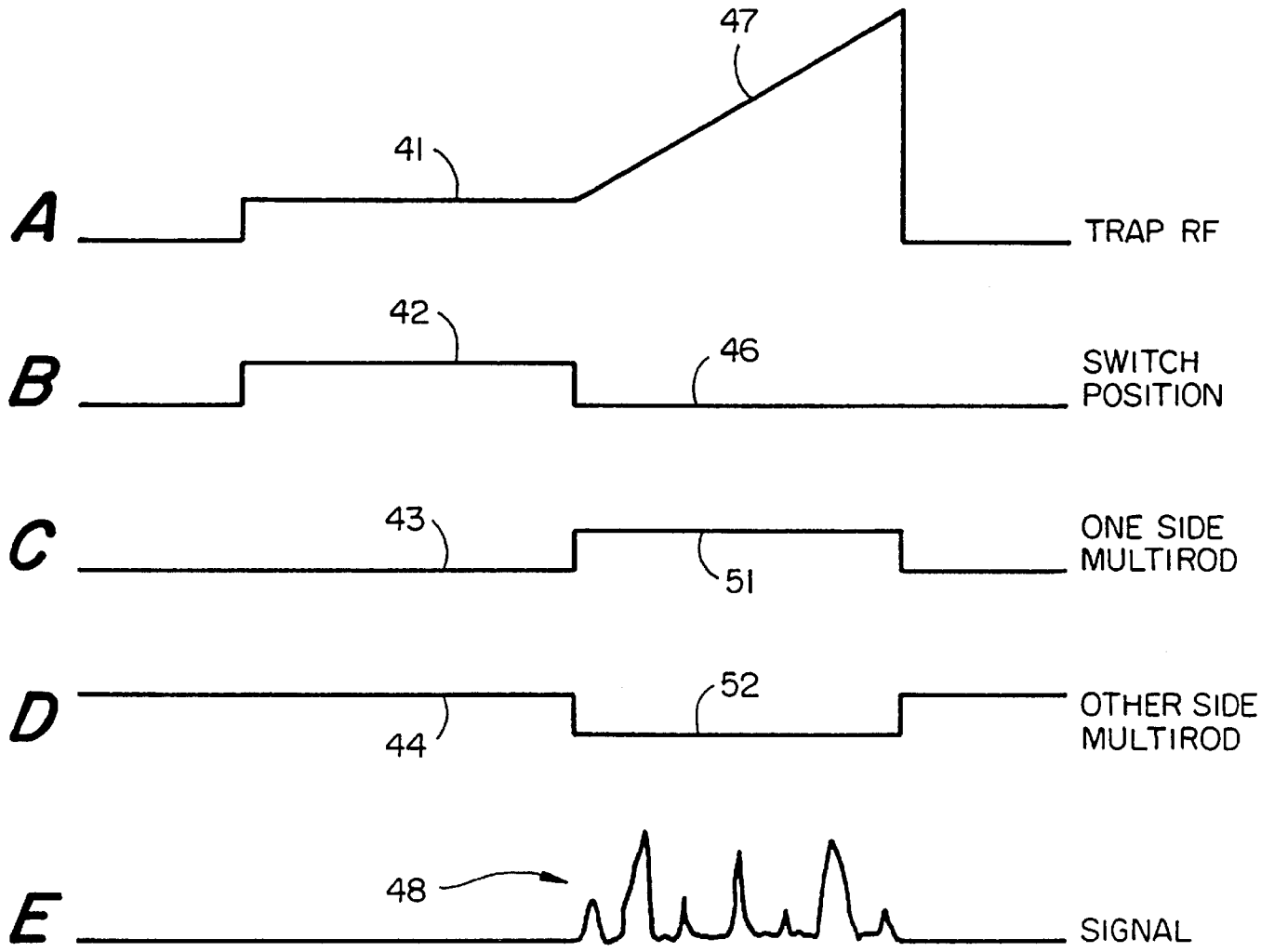
FIG. 7 shows the timing sequence for injection of ions into the ion trap mass spectrometer and for mass analysis with noise suppression.

The timing is illustrated in FIGS. 7A–7E. FIG. 7A illustrates the ionization source turned on and sufficient RF voltage 41 applied to the quadrupole ion trap 10 to trap injected ions. The position of the switch 36 is schematically shown at 42, FIG. 7B, set such that both sides of the ion guide rods 1–8 are at appropriate DC bias voltage 43, FIG. 7C, and 44, FIG. 7D, e.g. −3 volts. The RF voltages 41 applied to the rods allow ions to be transferred into the ion trap for some defined amount of time. Subsequently, the switch 46 is toggled as schematically shown in FIG. 7B, and the RF voltage 47, FIG. 7A, is applied to the ion trap to scan in accordance with the teaching of U.S. Pat. No. 4,540,884 and/or U.S. Pat. No. 4,736,101. Ions are ejected from the ion trap, detected by detector, and the output of the detector is processed to provide a mass spectrum 48, FIG. 7E. In accordance with the present invention, while the ion trap is analyzing previously transmitted ions, a DC dipole field is applied across the rods on both sides of the center line. The voltages 51,52 applied to the rods are illustrated in FIGS. 7C and 7D.

Thus, the method and apparatus consists of using RF ion guides such as quadrupoles, hexapoles and octopoles, and superimposing a transverse dipole electric field along the length of the ion guide when performing mass analysis to eliminate noise from ions or charged particles.

Figure 8:
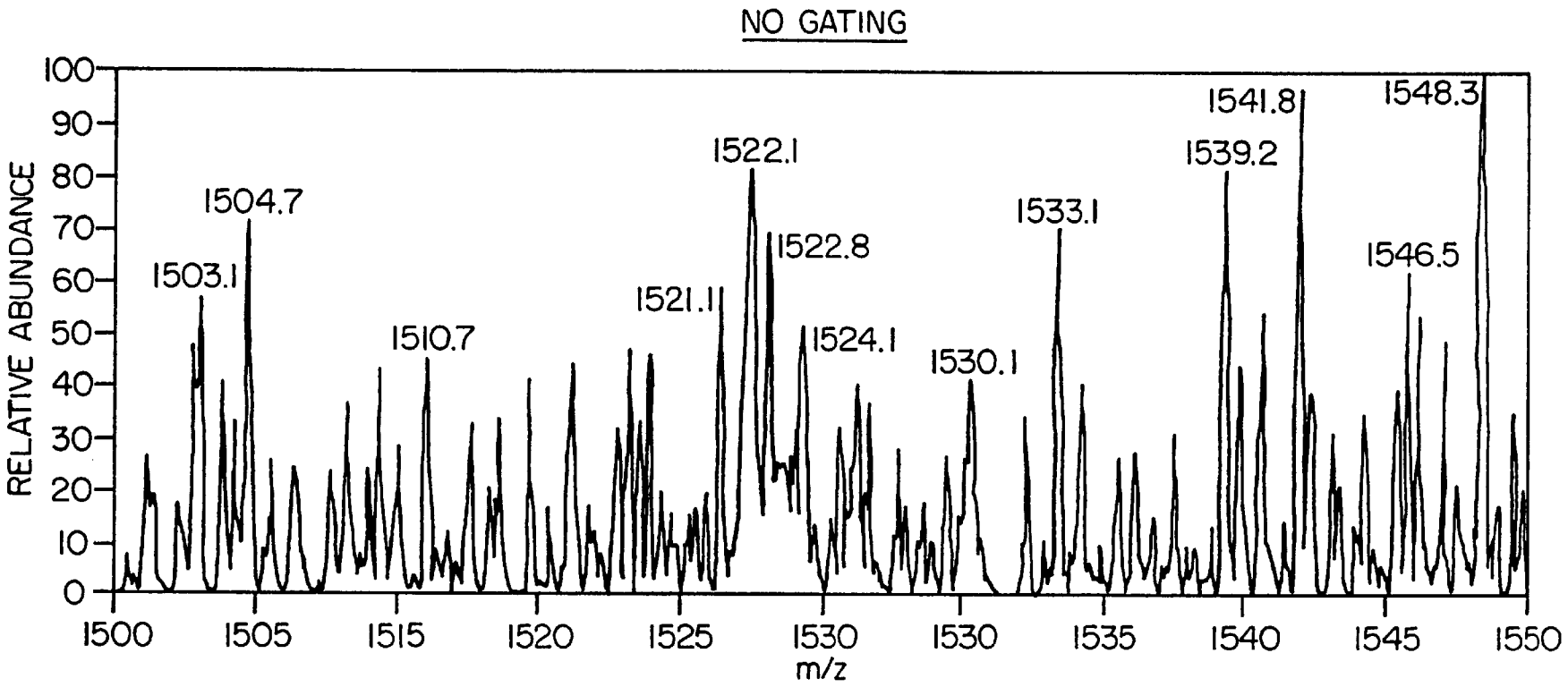
FIG. 8 shows the m/z 1522 region of the mass spectra of Ultramark 1621 without noise suppression.
Figure 9:
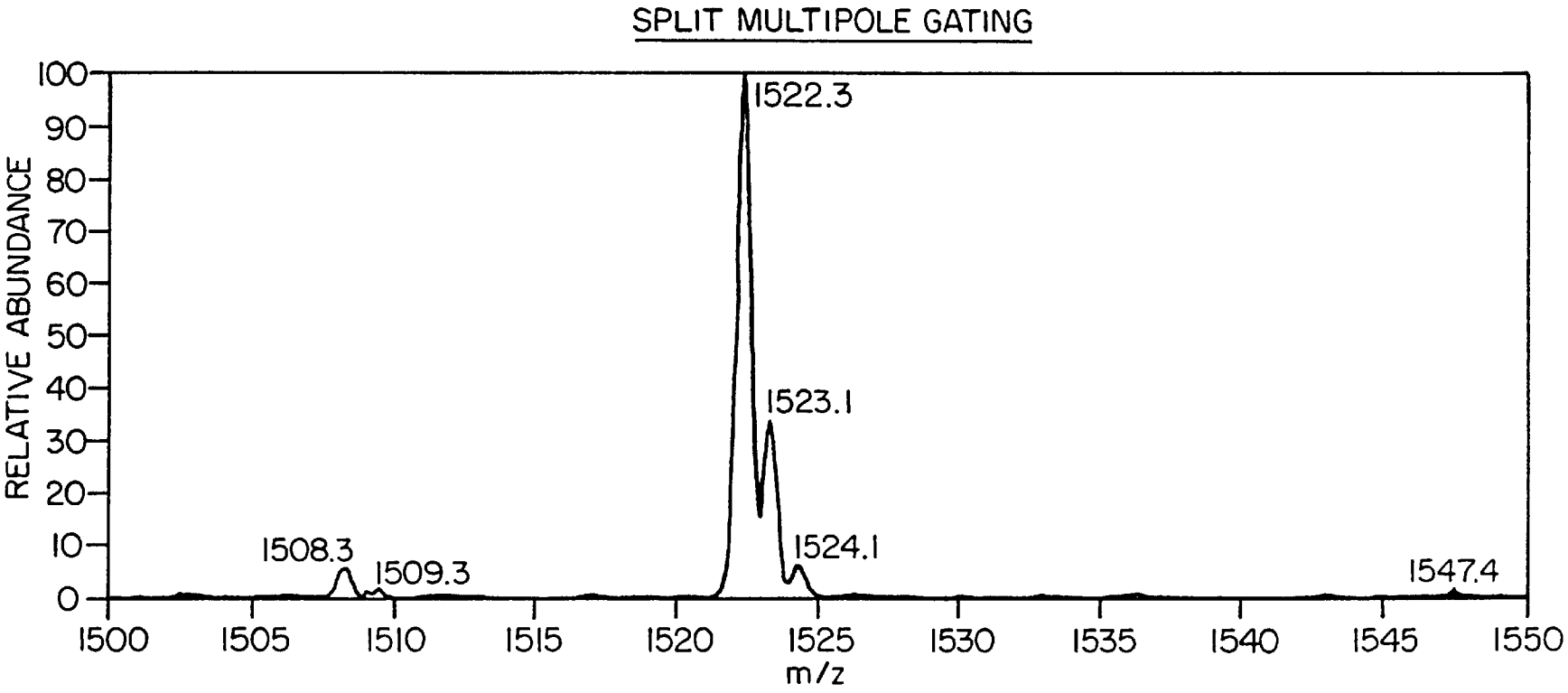
FIG. 9 shows mass spectra of the m/z 1522 region of the mass spectra of Ultramark 1621 with noise suppression in accordance with the present invention.

An atmospheric pressure ion source connected to an ion trap mass spectrometer, as illustrated in FIG. 1, was operated to analyze the m/z 1522 region of the mass spectra of Ultramark 1621. FIG. 8 shows the resulting mass spectrum without using the transverse dipole field during mass analysis, while FIG. 9 shows the mass spectrum obtained with applying the transverse dipole field applied to the rods of the octopole ion guide 23, FIG. 1. It is clear from the mass spectrum of FIGS. 8 and 9 that the noise has been substantially eliminated.

What is claimed is:

1. An ion transfer assembly for directing ions from an ionization source to an ion trap mass spectrometer including:

a multi-rod ion guide for transmitting ions to the ion trap mass spectrometer for analysis;

means for applying RF voltages of opposite phase between alternate rods for guiding for a predetermined time ions from the ionization source into the ion trap for analysis; and switch means for selectively applying DC dipole voltage between opposite rods to create a transverse dipole deflection field during the time that the ions transferred into the ion trap mass spectrometer are being analyzed, said transverse dipole field serving to deflect charged particles and ions so that they do not enter the ion trap while it is performing mass analysis.

2. An ion transfer assembly as in claim 1 in which the multiple ion guide includes eight parallel rods.

3. An ion transfer assembly as in claim 1 in which the multi-rod ion guide includes six parallel rods.

4. An ion transfer assembly as in claim 1 in which the multi-rod ion guide includes four parallel rods.

5. An ion guide transfer assembly as in claim 1, 2, 3 or 4 in which the rod are square.

6. An ion guide transfer assembly as in claim 1, 2, 3 or 4 in which the rods are cylindrical.

7. A mass spectrometer assembly including an ion source, and an ion trap mass spectrometer for analyzing the ions from said ion source characterized in that a multi-rod ion guide for transmitting ions from said ion source to said ion trap mass spectrometer, a transformer including multiple secondary windings for applying RF and DC voltages to said rods, said secondary windings connected to switch means for selectively applying RF voltages of opposite phase to alternate rods of said multi-rod ion guide for transmitting ions from the ion source to the mass spectrometer and for applying DC voltages of opposite polarity to opposite rods while the ion trap mass spectrometer is analyzing ions which have been guided into the ion trap to deflect charged particles and ions and prevent them from entering the ion trap during analysis of transmitted ions.

8. The method of operating an ion trap mass spectrometer in which ions are transmitted from an ion source to said ion trap mass spectrometer through multi-rod ion guides comprising the steps of applying RF voltages of opposite phase to alternate rods of said multi-rod ion guide to transmit ions from said ion source to said ion trap for analysis and selectively applying DC voltages of opposite polarity to opposite rods of said multi-rod ion guide to deflect charged particles and ions during analysis of transmitted ions by the ion trap to prevent charged particles and ions from entering the ion trap during analysis of the transmitted ions.

* * * * *